US006767013B2

(12) United States Patent
Lehmann

(10) Patent No.: US 6,767,013 B2
(45) Date of Patent: Jul. 27, 2004

(54) TURNING DEVICE FOR INDIVIDUAL SHEETS

(75) Inventor: Jürgen Lehmann, Schönwald (DE)

(73) Assignee: Mathias Bäuerle GmbH, St. Georgen (DE)

( * ) Notice: Subject to any disclaimer, the term of this patent is extended or adjusted under 35 U.S.C. 154(b) by 76 days.

(21) Appl. No.: 10/138,467

(22) Filed: May 3, 2002

(65) Prior Publication Data

US 2002/0171195 A1 Nov. 21, 2002

(30) Foreign Application Priority Data

May 4, 2001 (DE) ..... 101 23 641

(51) Int. Cl.[7] ..... B65H 29/00
(52) U.S. Cl. ..... 271/186; 271/65; 271/301
(58) Field of Search ..... 271/186, 65, 301, 271/291

(56) References Cited

U.S. PATENT DOCUMENTS 3,227,444 A * 1/1966 Egan ..... 271/65
4,319,190 A * 3/1982 Brown ..... 324/309
4,905,984 A * 3/1990 Haigh ..... 271/270
6,477,950 B1 * 11/2002 Feilen et al. ..... 101/230

FOREIGN PATENT DOCUMENTS

JP 06032540 A * 2/1994 ..... B65H/83/02

* cited by examiner

*Primary Examiner*—Donald P. Walsh
*Assistant Examiner*—Kaitlin Joerger
(74) *Attorney, Agent, or Firm*—Gudrun E. Huckett

(57) ABSTRACT

A turning device for individual sheets has at least one transport unit transporting individual sheets. At least one turning unit turns the individual sheets by 180° to turned sheets while they are being transported to a processing station arranged downstream. At least one vacuum element is arranged proximal to the at least one turning unit and transports the turned sheets in a direction toward the processing station arranged downstream.

24 Claims, 1 Drawing Sheet

TURNING DEVICE FOR INDIVIDUAL SHEETS

BACKGROUND OF THE INVENTION

1. Field of the Invention

The invention relates to a turning device for individual sheets comprising at least one transport unit for transporting the individual sheets and further comprising at least one turning unit with which the individual sheets can be turned about 180° during their transport to a station arranged downstream.

2. Description of the Related Art

Such turning devices are known, for example, in folding machines and are used, for example, for combining individual sheets to sheet sets for inserting them into an envelope, respectively. The sequence of the supplied individual sheets is determined by the endless printing process. Accordingly, the further processing in a machine or station arranged downstream can present a problem when the printed image is on the wrong side of the individual sheets.

SUMMARY OF THE INVENTION

It is an object of the present invention to configure the turning device according to the invention such that the individual sheets can be transported such that the sheets can undergo further processing without any problems in the station arranged downstream.

In accordance with the present invention, this is achieved in that at least one vacuum element is arranged in the area of the turning unit with which the turned sheet can be transported toward the station arranged downstream.

In the turning device according to the invention, the vacuum element enables a quick further transport of the individual sheet after it has been turned by 180°. The turning device therefore has a high efficiency. The efficiency can be increased even more when the suction element is adjusted such that the individual sheets to be transported by it overlap one another.

BRIEF DESCRIPTION OF THE DRAWING

The only drawing

DESCRIPTION OF THE PREFERRED EMBODIMENTS

Figure 1:
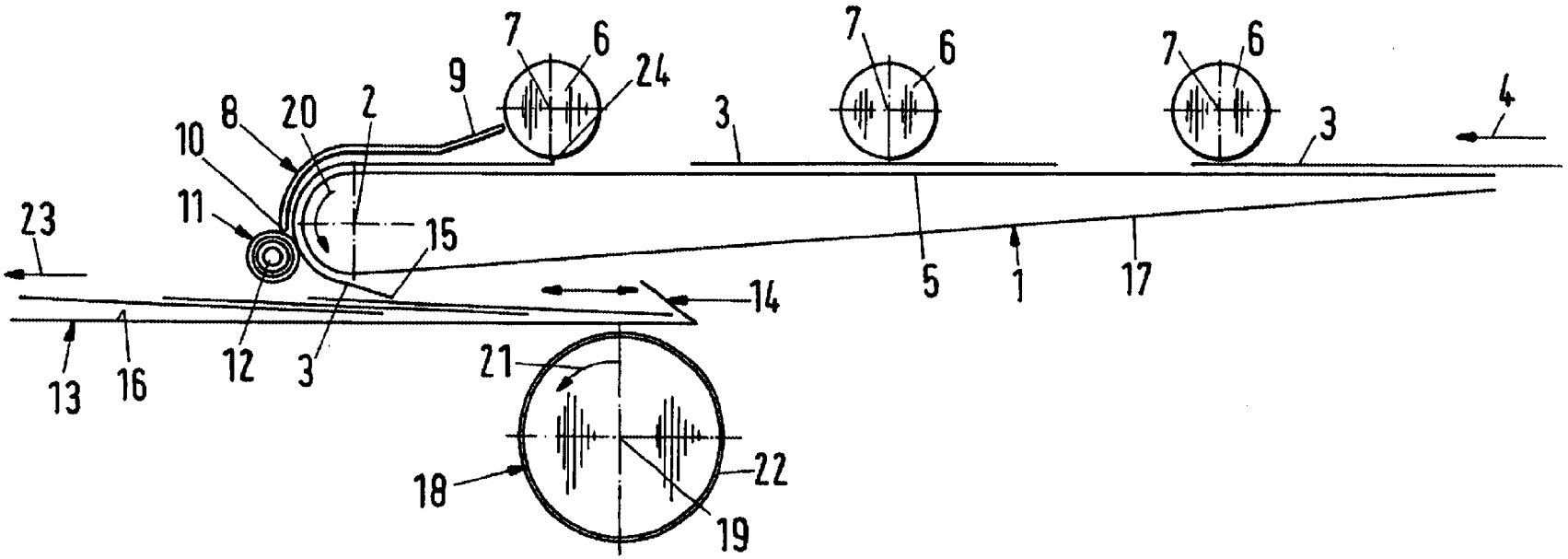
FIG. 1 shows a schematic side view of the turning device according to the invention for turning individual sheets.

The turning device comprises an endless transport belt 1 which is guided about two deflection pulleys. The deflection pulleys are illustrated in the drawing only schematically by the axis of rotation 2 of one of the pulleys. The individual sheets 3 are transported with minimal spacing from one another by the transport belt 1 in the transport direction illustrated by arrow 4. In the area above the carrying run 5 of the transport belt 1, rollers 6 are arranged at a spacing from one another. They are positioned at the same level, and their axes 7 extend parallel to the axis of rotation 2 of the deflection pulleys. The rollers 6 ensure that the individual sheets 3 are transported reliably on the transport or conveyor belt 1. The rollers 6 can be driven in rotation so that they transport the individual sheets 3 together with the transport belt 1 in the transport direction (arrow 4).

In the forward deflection area viewed in the transport direction (arrow 4), a deflection part or plate 8 is provided which has a minimal spacing from the transport belt 1 and ensures that the individual sheets 3 are reliably turned by 180°. In the drawing FIG. 1, one of the individual sheets 3 is illustrated in this deflection area between the deflection plate 8 and the transport belt 1.

In the area of the carrying run 5, the deflection plate 8 has an insertion end or insertion part 9 which is upwardly oriented and points counter to the transport direction of arrow 4. It ensures that the individual sheets 3 are reliably directed under the deflection plate 8. The insertion end 9 projects so as to end in close proximity to the neighboring roller 6, as shown in FIG. 1. In the deflection area, the deflection plate 8 extends coaxially to the corresponding area of the transport belt 1 approximately to the level of a horizontal plane in which the axis of rotation 2 of the deflection pulley is located. Directly adjacent to the forward end 10 of the deflection plate 8, viewed in the transport direction indicated by arrow 4, a turning aid in the form of a roller 11 is arranged whose axis 12 is positioned parallel to the axis of rotation 2 of the neighboring deflection pulley. The roller 11 is advantageously provided on its mantle surface with a fluting which extends parallel to the axis of the roller 12. The end 10 of the deflection plate 8 projects so as to end in close proximity to the mantle surface of the roller 11. This ensures that the individual sheet 3 can be reliably transported father in the deflection area in a way to be described in the following.

In the area below the deflection area of the transport belt 1, a support 13 is positioned which extends horizontally in the illustrated embodiment and projects past the deflection area of the transport belt 1 to the front and to the rear. At the rearward end, the support 13 is provided with a stop 14 on which the turned sheet 3 will abut with its end 15. The stop 14 is advantageously a unitary part of the sheet-shaped or plate-shaped support 13 and is formed by an angled or bent end portion. In the illustrated embodiment, the stop 14 is positioned at an acute angle to the support surface 16 of the support 13. Since the stop 14, beginning at the support surface 16, extends at a slant toward the non-carrying run 17 of the transport belt 1 and the support surface 16 has only a minimal spacing from the deflection area of the transport belt 1, the non-carrying run 17 of the transport belt 1 extends from the forward deflection area, viewed in the transport direction (arrow 4), at a slant in the direction toward the carrying run 5. Of course, the stop 14 can also be arranged such that the non-carrying run 17 extends parallel to the carrying run 5.

In order for the turning device to be adjustable to different sizes of the individual sheets 3, the spacing between the roller 11 and the stop 14 is advantageously adjustable. In this connection, the transport unit 1 with the deflection plate 8 and the roller 11 and/or the support 13 and/or the stop 14 can be adjusted relative to one another.

In the area underneath the support 13 in the vicinity of the stop 14 a vacuum element in the form of a vacuum drum 18 is provided whose axis of rotation 19 is positioned parallel to the axis of rotation 2 of the deflection pulley. The deflection pulley of the transport belt 1 and the vacuum drum 18 rotate in the same direction of rotation (arrows 20 and 21). The vacuum drum 18 is configured in a way known in the art and connected to a vacuum source (not illustrated) for generating a vacuum in the vacuum drum 18. The mantle surface 22 of the vacuum drum 18 has openings (not illustrated). The support 13 is provided with at least one opening (not illustrated) in the area of the vacuum drum 18. In this way, the vacuum can act on the individual sheet 3 positioned on the support 13, and the individual sheet 3 is pulled in this way tightly against the support surface 16. Since the vacuum drum 18 rotates in the rotational direction 21, the individual sheet 3 which is initially resting against the stop 14 is then transported father on the support 13 in the direction of arrow 23 (corresponding to the original transport direction—arrow 4—on the transport belt 1).

Instead of the vacuum drum it is also possible to employ other suction or vacuum elements 18, for example, an endless, revolving vacuum belt with which the turned individual sheets 3 are transported in the direction of arrow 23 with vacuum assistance. The vacuum belt is provided with openings so that the vacuum can act on the individual sheets 3.

The individual sheets 3 are initially transported sequentially at a small spacing to one another about the deflection pulley of the transport belts 1 under the deflection plate 8. The individual sheets 3 are then transported counter to the original transport direction (arrow 4) on the support 13 in the direction of arrow 4' until they reach the stop 14. The roller 11 ensures that the trailing edge 24 of the individual sheet 3 is deflected properly downwardly and will not collide with the trailing individual sheet 3. The turned individual sheet 3 will impact with its leading edge 15 on the stop 14 and is thus stopped. The vacuum drum 18 transports the individual sheet 3 deposited on the support 13 again in the original direction, indicated by arrow 23, along the support 13. The double arrow (4', 23) above the vacuum drum 18 indicates these two movement directions. The transport speed on the support 13 is significantly slower than the transport speed on the transport belt 1. In this way, the individual sheets 3 will be placed in an imbricated arrangement on the support 13, as illustrated in the drawing FIG. 1. This imbricated flow is comprised of individual sheets 3 which have been turned by 180° compared to the position of the sheets 3 on the transport belt 1. The sequence of the individual sheets 3 has not changed after having been turned by 180°.

Generating the vacuum by means of the vacuum drum 18 is realized in a cycled fashion. Upon entry of the first individual sheet 3 of the imbricated flow, the vacuum is turned off in order not to impede the movement of this first individual sheet 3. The rotational speed of the vacuum drum 18 is cycled or timed such and so slow that the vacuum drum 18 will not be exposed (free of the sheet 3) until the following individual sheet 3 rests against the stop 14. Should the spacing between two sequentially arriving individual sheets be greater, the vacuum drum 18 is stopped before it is exposed again.

In order to control the cycled operation of the vacuum drum 18 as a function of supplying the individual sheets 3, it is possible, for example, to employ light barriers which are arranged along the movement path of the individual sheets 3 on the transport belts 1 or in the area of the stop 14 and, as a function of the spacing of the individual sheets 3 from one another, send signals to a control device with which the timing of the vacuum drum 18 is controlled. This ensures that there is always an individual sheet 3 positioned on the vacuum drum 18 so that it is not free or exposed (not covered by a sheet 3).

The described transport device ensures that the sequence of the supplied individual sheets is maintained and the printed image is correctly positioned in the machine which is arranged downstream of the transporting device. As a result of turning the sheets by 180°, the individual sheets 3 will reach the machine arranged downstream in the required position for further processing.

The speed of the vacuum drum 18 can be controlled such that the turned individual sheets 3 upon further transport will not overlap one another but, for example, have a spacing relative to one another. In this case, the vacuum or suction air is cycled for each individual sheet 3, i.e., is switched off.

While specific embodiments of the invention have been shown and described in detail to illustrate the inventive principles, it will be understood that the invention may be embodied otherwise without departing from such principles.

What is claimed is:

1. A turning device for individual sheets, comprising:

at least one transport unit transporting individual sheets;

at least one turning unit configured to turn the individual sheets by 180° to turned sheets while being transported to a processing station arranged downstream;

at least one vacuum element arranged proximal to the at least one turning unit and configured to transport the turned sheets in a direction toward the processing station arranged downstream; and wherein the at least one vacuum element transports the turned sheets in a direction identical to the first transport direction.

2. The turning device according to claim 1, wherein the at least one turning unit is arranged downstream of the at least one transport unit.

3. The turning device according to claim 1, wherein the at least one turning unit has at least one deflection part having a leading end widening counter to a first transport direction of the individual sheets on the at least one transport unit.

4. The turning device according to claim 3, wherein the at least one transport unit comprises an endless transport belt having a forward deflection area in the first transport direction of the individual sheets.

5. The turning device according to claim 4, wherein the at least one deflection part is arranged in the forward deflection area of the transport belt.

6. The turning device according to claim 5, wherein the at least one deflection part extends parallel to the transport belt in the forward deflection area.

7. The turning device according to claim 6, wherein the at least one turning unit has at least one support for receiving the turned sheets.

8. The turning device according to claim 7, wherein the turned sheets are initially transported on the at least one support in a second transport direction opposite to the first transport direction.

9. The turning device according to claim 7, wherein the at least one support has at least one stop for the turned sheets.

10. The turning device according to claim 9, wherein the at least one stop is oriented counter to the second transport direction of the turned sheets.

11. The turning device according to claim 9, wherein the at least one stop is an angled end portion of the at least one support.

12. The turning device according to claim 7, wherein the at least one support is arranged below the forward deflection area of the transport unit.

13. The turning device according to claim 1, wherein the at least one vacuum element is comprised of at least one rotatably driven vacuum drum.

14. The turning device according to claim 1, wherein the at least one vacuum element is comprised of at least one vacuum belt.

15. The turning device according to claim 7, wherein the at least one support has at least one opening in the area of the at least one vacuum element.

16. The turning device according to claim 1, wherein the at least one vacuum element has a transport speed that is smaller than a transport speed of the at least one transport unit.

17. The turning device according to claim 7, wherein the at least one turning unit comprises at least one turning aid arranged in the transition area between the deflection part and the at least one support.

18. The turning device according to claim 17, wherein the at least one turning aid is a roller.

19. The turning device according to claim 18, wherein the at least one vacuum element is a drum and wherein an axis of the roller extends parallel to an axis of the vacuum drum.

20. The turning device according to claim 18, wherein the at least one turning aid is a roller having a surface with fluting.

21. The turning device according to claim 20, wherein the fluting extends parallel to an axis of the roller.

22. The turning device according to claim 17, wherein the at least one support has at least one stop for the turned sheets and wherein a spacing between the at least one turning aide and the at least one stop is adjustable.

23. The turning device according to claim 1, wherein the rotational speed of the at least one vacuum element is controlled as a function of a transport speed of the at least one transport unit.

24. The turning device for individual sheets, comprising:

at least one transport unit transporting individual sheets;

at least one turning unit configured to turn the individual sheets by 180° to turned sheets while being transported to a processing station arranged downstream;

at least one vacuum element arranged proximal to the at least one turning unit and configured to transport the turned sheets in a direction toward the processing station arranged downstream;

wherein the at least one turning unit has at least one deflection part and at least one support for receiving the turned sheets;

wherein the at least one turning unit comprises at least one turning aid arranged in a transition area between the deflection part and the at least one support;

wherein the at least one support has at least one stop for the turned sheets and wherein a spacing between the at least one turning aide and the at least one stop is adjustable.

* * * * *